US010269524B2

(12) United States Patent
Kawase et al.

(10) Patent No.: US 10,269,524 B2
(45) Date of Patent: Apr. 23, 2019

(54) MULTIPLE FUSE DEVICE

(71) Applicant: Pacific Engineering Corporation, Ogaki-shi (JP)

(72) Inventors: Fumiyuki Kawase, Ogaki (JP); Manabu Ota, Ogaki (JP)

(73) Assignee: Pacific Engineering Corporation, Ogaki-Shi (JP)

( * ) Notice: Subject to any disclaimer, the term of this patent is extended or adjusted under 35 U.S.C. 154(b) by 4 days.

(21) Appl. No.: 15/599,825

(22) Filed: May 19, 2017

(65) Prior Publication Data

US 2018/0019085 A1 Jan. 18, 2018

(30) Foreign Application Priority Data

Jul. 13, 2016 (JP) ..... 2016-138264

(51) Int. Cl.
*H01H 85/12* (2006.01)
*H01H 69/02* (2006.01)
(Continued)

(52) U.S. Cl.
CPC ..... *H01H 85/12* (2013.01); *H01H 69/02* (2013.01); *H01H 85/044* (2013.01); *H01H 2085/0555* (2013.01)

(58) Field of Classification Search
CPC ..... H01H 85/12; H01H 85/044; H01H 69/02; H01H 2085/0555
See application file for complete search history.

(56) References Cited

U.S. PATENT DOCUMENTS 9,607,798 B2 * 3/2017 Onoda ..... H01H 69/02
2002/0167390 A1 * 11/2002 Matsumura ..... H01H 85/044 337/161

(Continued)

FOREIGN PATENT DOCUMENTS

JP 2003180018 A * 6/2003
JP 2005185035 A * 7/2005 ..... H01H 85/044
JP 2015-022866 A 2/2015

OTHER PUBLICATIONS

Kawamura Hideki; Yamazaki Tetsuyoshi; Sugiura Tomohiro; Suzuki Yasuhito, Fuse Connection Structure of Bus Bar and Electric Connection Box Comprising It, Jul. 7, 2005, Yazaki Corp, Entire Document (Translation of JP 2005185035).*

(Continued)

*Primary Examiner* — Anatoly Vortman
*Assistant Examiner* — Stephen S Sul
(74) *Attorney, Agent, or Firm* — Shumaker, Loop & Kendrick, LLP

(57) ABSTRACT

The present invention provides a multiple fuse device that is compatible with various ratings and reduces an increase in manufacturing cost. A multiple fuse device includes an input terminal, an external terminal, a bus bar that includes a circuit portion disposed between the input terminal and the external terminal, and a housing that covers the bus bar. The external terminal includes an integral external terminal integrated with the circuit portion with a fusible portion interposed between the integral external terminal and the circuit portion, and a fuse-side external terminal that pairs up with a fuse connection terminal connected to the circuit portion. The fuse connection terminal and the fuse-side external terminal provided in a pair hold a fuse exteriorly in a removable manner, the fuse having a fusible portion (Continued)

connected between the fuse connection terminal and the fuse-side external terminal.

1 Claim, 16 Drawing Sheets

(51) Int. Cl.
*H01H 85/044* (2006.01)
*H01H 85/055* (2006.01)

(56) References Cited

U.S. PATENT DOCUMENTS

2010/0328018 A1* 12/2010 Matsumoto ..... H01H 85/0417
337/187
2016/0064887 A1* 3/2016 Ishikawa ..... H01H 85/044
264/138

OTHER PUBLICATIONS

Terunuma Ichiro; Kosugi Hideyuki; Momota Atsushi, "Electrical Junction Box and Connector", Jun. 27, 2003, Fujikura LTD, Entire Document (Translation of JP2003180018). (Year: 2003).*

* cited by examiner

MULTIPLE FUSE DEVICE

TECHNICAL FIELD

The present invention relates to a fuse device for use in , for example, an electric circuit for an automobile, and more particularly, to a multiple fuse device having a plurality of external terminals.

BACKGROUND

Fuse devices have been used for protecting electric circuits in, for example, an automobile and various electrical components connected to the electric circuits. Specifically, if unintended overcurrent flows into an electric circuit, a fuse device protects an electrical component from the inflow of excessive current in such a manner that a fusible portion thereof is cut by heat generated due to the overcurrent.

Various kinds of fuse devices have been available in accordance with their applications. For example, JP 2015-022866 A discloses a multiple fuse device for use in a vehicle, the multiple fuse device establishing a connection between a battery and wires for supplying electric power to various electrical components. The multiple fuse device has a plurality of external terminals respectively coupled to the electrical components, and fusible portions interposed between the respective external terminals and the battery to protect the corresponding electrical components from the inflow of excessive current. The multiple fuse device disclosed in JP 2015-022866 A includes a bus bar formed by integral molding using a die. The bus bar includes an input terminal receiving electric power from the battery, the external terminals respectively coupled to the electrical components, a circuit portion disposed between the input terminal and the external terminals, and the fusible portions.

However, since kinds and sizes of loads such as various electrical components differ depending on types of vehicles, service conditions, and the like, ratings of fusible portions are changed accordingly. Moreover, the changes of the ratings cause changes in the shapes and the like of the fusible portions. This results in change of a die for manufacturing a bus bar of a fuse device, which disadvantageously leads to a great increase in cost.

SUMMARY

Disclosed herein is a multiple fuse device that is compatible with various ratings and reduces an increase in manufacturing cost.

The multiple fuse device disclosed herein includes an input terminal, an external terminal, a bus bar that includes a circuit portion disposed between the input terminal and the external terminal, and a housing that covers the bus bar. The external terminal includes an integral external terminal integrated with the circuit portion with a fusible portion interposed between the integral external terminal and the circuit portion, and a fuse-side external terminal that pairs up with a fuse connection terminal connected to the circuit portion. The fuse connection terminal and the fuse-side external terminal provided in a pair hold a fuse exteriorly in a removable manner, the fuse having a fusible portion connected between the fuse connection terminal and the fuse-side external terminal.

According to this configuration, the multiple fuse device easily copes with a change in rating of a fusible portion associated with changes in types of vehicles, service conditions, and the like in such a manner that a fuse with a desired rating is appropriately mounted to the multiple fuse device. Unlike the conventional art, therefore, the multiple fuse device disclosed herein has no need to change a die depending on a change in rating of a fusible portion, which advantageously reduces manufacturing cost.

As described above, the multiple fuse device disclosed herein is compatible with various ratings and reduces an increase in manufacturing cost.

DETAILED DESCRIPTION

An embodiment of the present invention will be described below with reference to the drawings. It should be noted that shapes, materials, and the like of members constituting a multiple fuse device to be described in the following embodiment are merely examples, and the present invention is therefore not limited thereto. Like reference numbers refer to like elements throughout the various drawings.

Figure 1A:
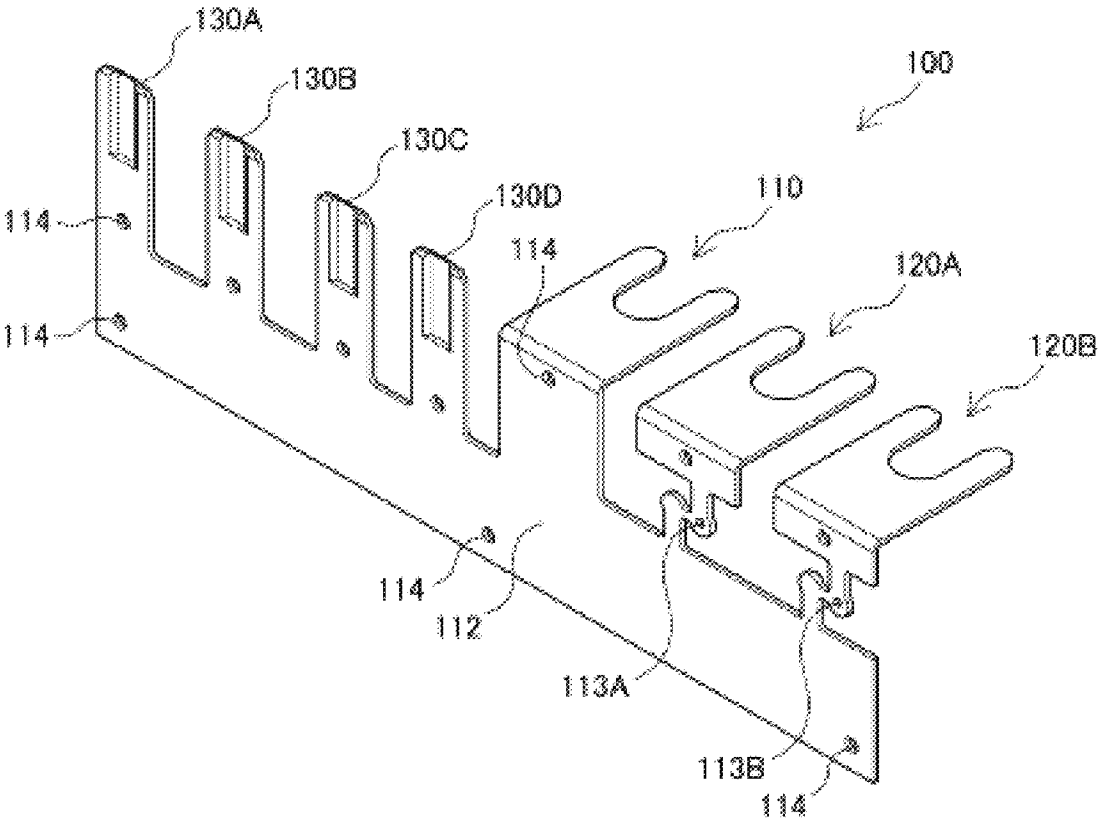
FIG. 1A is a perspective view of a bus bar of a multiple fuse device according to the present invention.
Figure 1B:
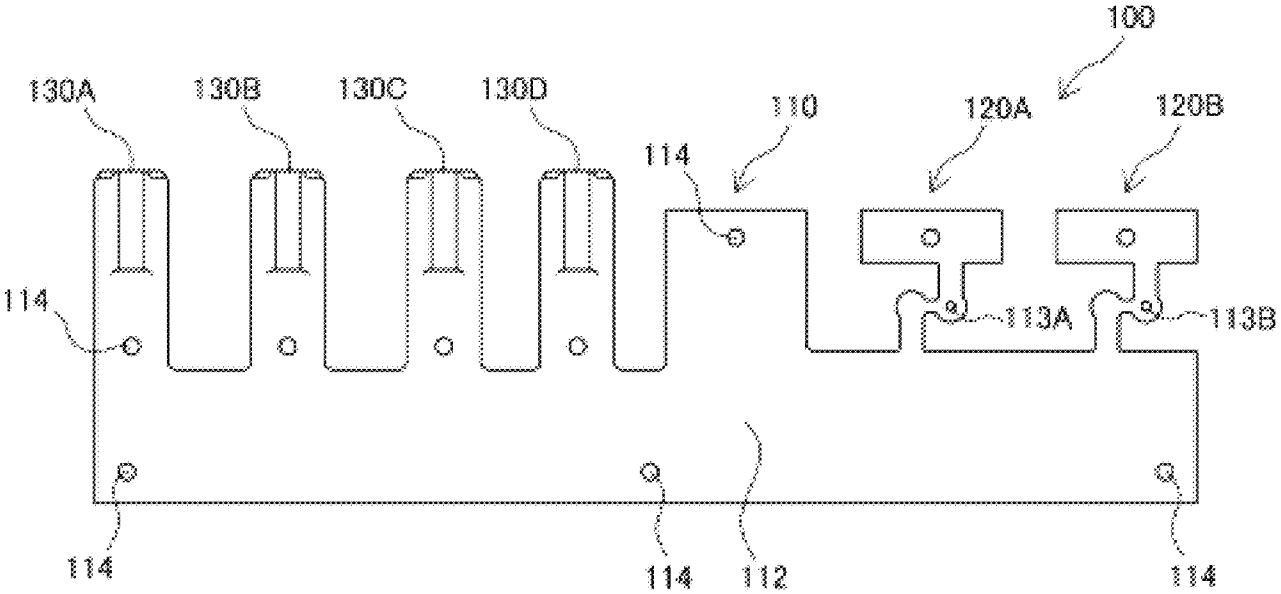
FIG. 1B is a front view of the bus bar.
Figure 1C:
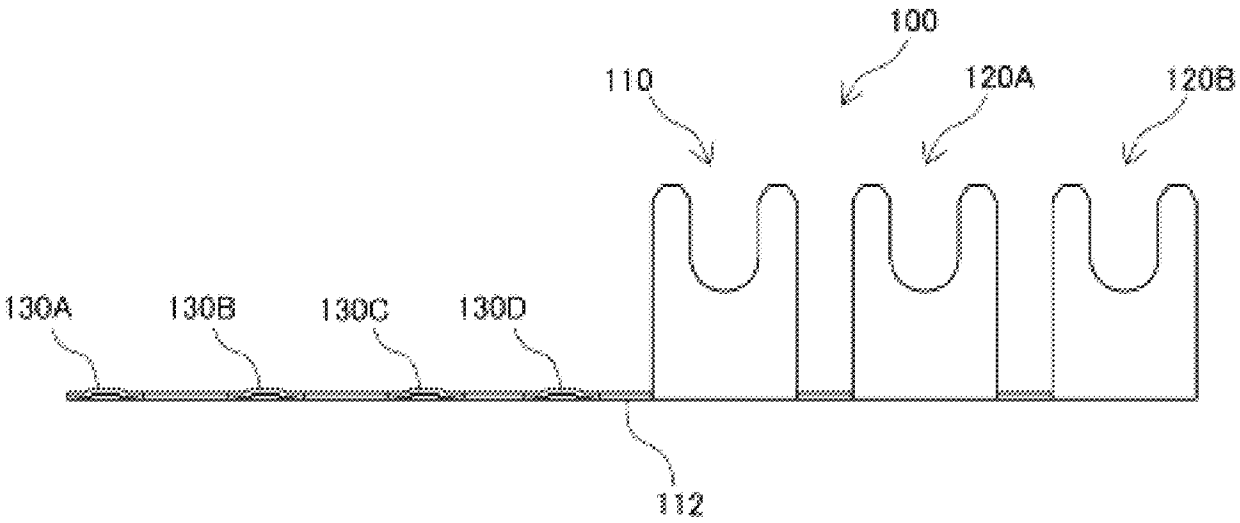
FIG. 1C is a plan view of the bus bar.

FIGS. 1A to 1C illustrate a bus bar 100 of a multiple fuse device according to the present invention. The bus bar 100 is formed from a single, thin metal plate by integral molding using a die. The bus bar 100 includes an input terminal 110 electrically connectable to, for example, a battery, a plurality of integral external terminals (120A and 120B), and a plurality of fuse connection terminals (130A to 130D). The input terminal 110 is connected to a circuit portion 112, and the integral external terminals 120 are respectively connected to the circuit portion 112 via fusible portions 113. Therefore, when overcurrent flows from a power supply such as the battery connected to the input terminal 110, the fusible portions 113 are cut to protect loads such as various electrical components coupled to the integral external terminals 120 from the inflow of excessive current.

Each of the fuse connection terminals (130A to 130D) has a proximal end connected to the circuit portion 112, and a distal end coupled to a fuse-side external terminal 140 coupled to an electrical component via a fuse to be described later. Therefore, when overcurrent flows from the power supply connected to the input terminal 110, fusible portions of the fuses respectively connected to the fuse connection terminals 130 are cut to protect loads coupled to the fuse-side external terminals 140 respectively from the inflow of excessive current.

Next, a brief description will be given of a method for molding the bus bar 100. First, a flat plate member having uniform thickness and made of a conductive metal such as copper or a copper alloy is die-cut into a predetermined shape, using a press machine or the like. Next, a region corresponding to the input terminal 110 is bent into an approximately 90° angle, and a region corresponding to the integral external terminals 120 is also bent into an approximately 90° angle. The bus bar 100 illustrated in FIGS. 1A to 1C is thus prepared.

Figure 2B:
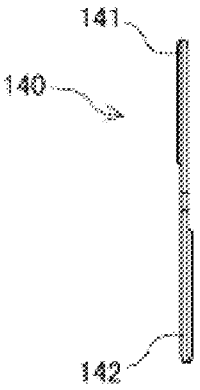
FIG. 2B is a side view of the fuse-side external terminal.
Figure 2A:
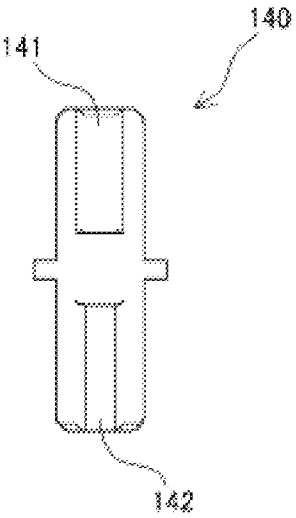
FIG. 2A is a front view of a fuse-side external terminal of the multiple fuse device according to the present invention.

With reference to FIGS. 2A and 2B, next, a description will be given of the fuse-side external terminals 140. Each of the fuse-side external terminals 140 is prepared as follows. That is, a flat plate member having uniform thickness and made of a conductive metal such as copper or a copper alloy is die-cut into a predetermined shape illustrated in FIGS. 2A and 2B, using a press machine or the like. As will be described in detail later, each of the fuse-side external terminals 140 has an upper end 141 and a lower end 142 formed into flat plate-shaped male terminals to be inserted into a fuse and a female terminal of an external connector, respectively.

Figure 3A:
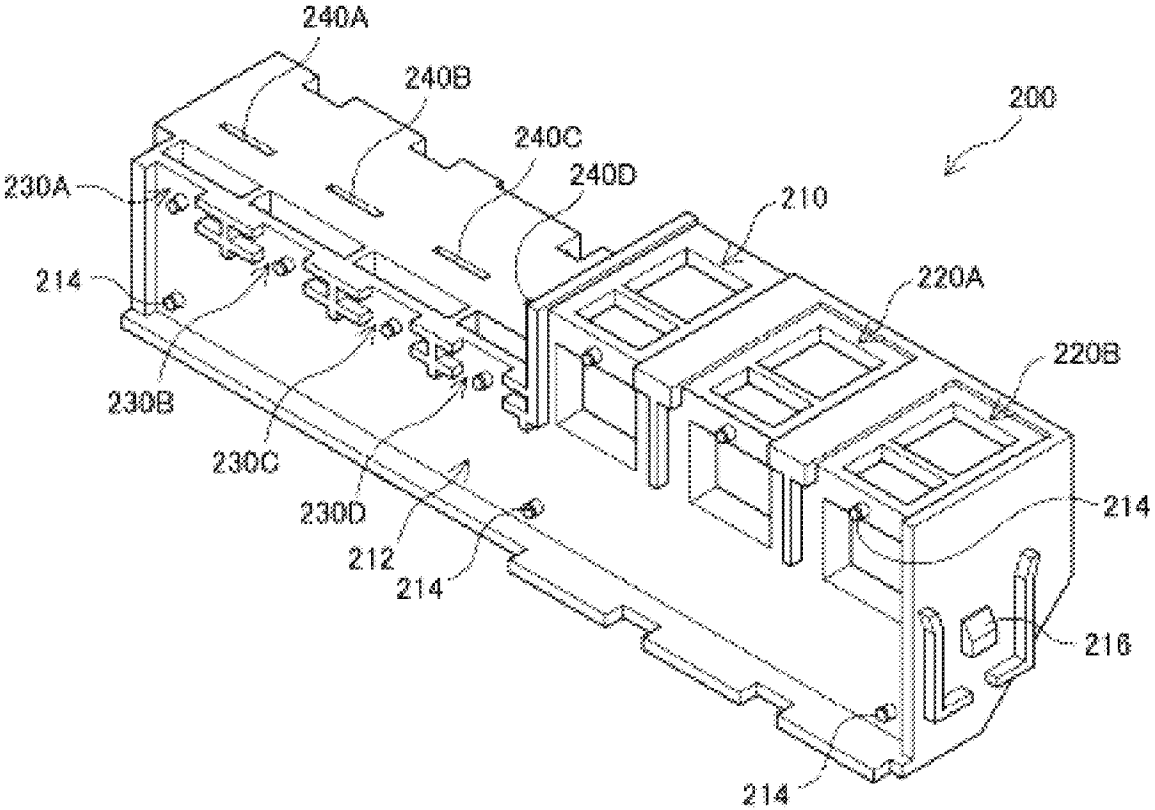
FIG. 3A is a perspective view of a lower housing that constitutes a housing of the multiple fuse device according to the present invention.
Figure 3B:
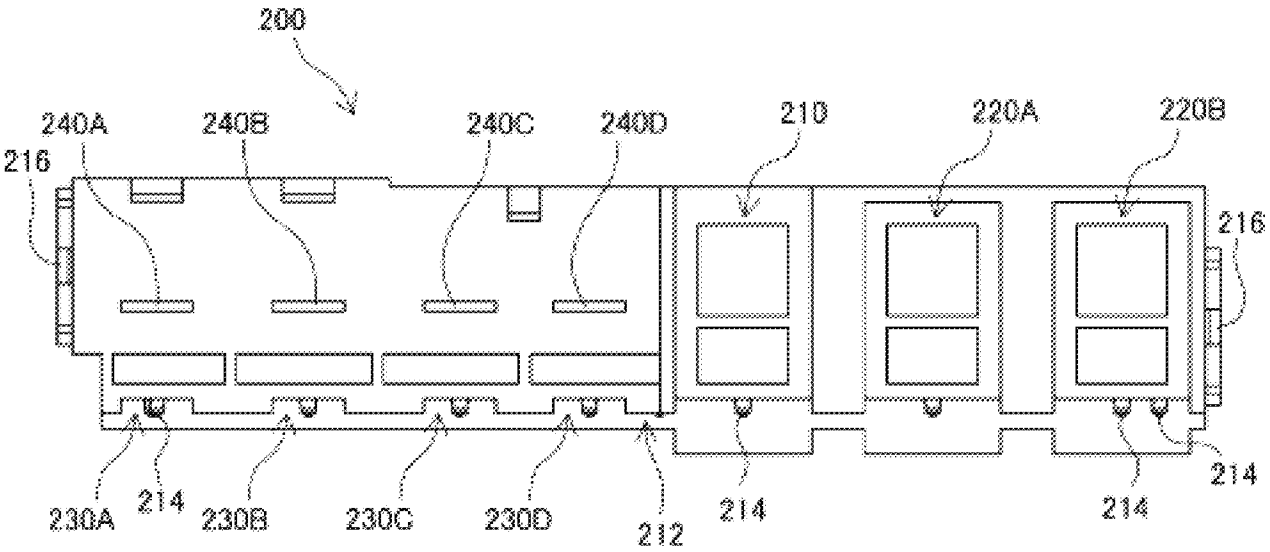
FIG. 3B is a plan view of the lower housing.
Figure 3C:
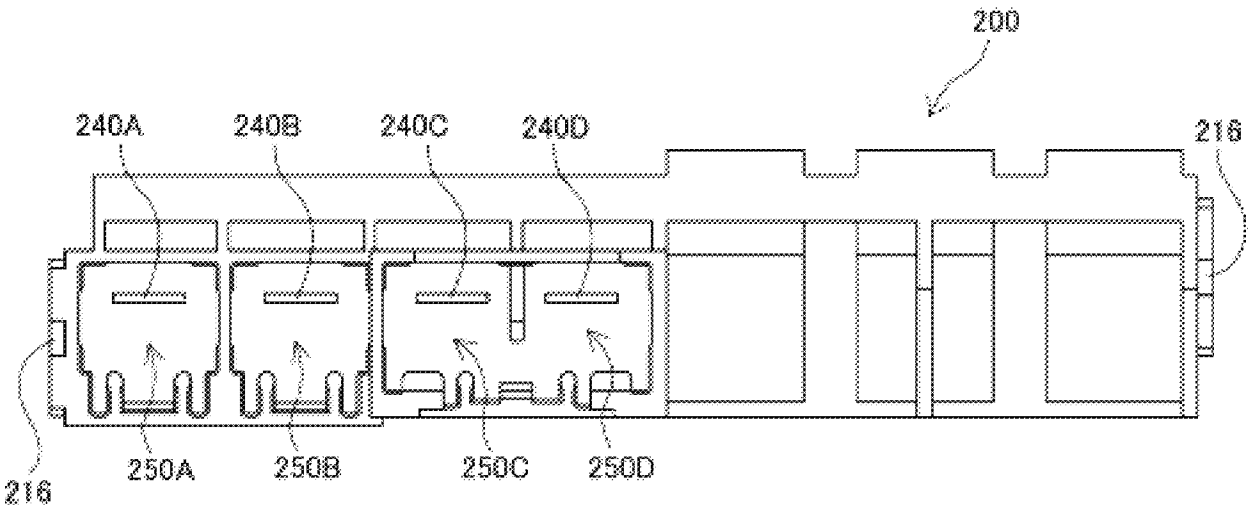
FIG. 3C is a bottom view of the lower housing.

With reference to FIGS. 3A to 3C, next, a detailed description will be given of a lower housing 200 that constitutes a housing 400 of the multiple fuse device according to the present invention. The lower housing 200 is made of, for example, an insulating synthetic resin and has an approximately rectangular parallelepiped shape. The lower housing 200 has, on an edge of its upper side, recesses (230A to 230D) formed with predetermined pitches such that the fuse connection terminals 130 of the bus bar 100 respectively protrude from the recesses (230A to 230D).

The lower housing 200 also has, at an approximately center of its upper side, slits (240A to 240D) formed in one-to-one correspondence with the recesses (230A to 230D) such that the lower ends 142 of the fuse-side external terminals 140 are respectively inserted into the slits (240A to 240D). Each of the slits (240A to 240D) is a through-hole extending from the front side to the back side of the lower housing 200.

The lower housing 200 also has, on its upper side, an input terminal placement portion 210 for placing the input terminal 110 of the bus bar 100, an external terminal placement portion 220A for placing the integral external terminal 120A of the bus bar 100, and an external terminal placement portion 220B for placing the integral external terminal 120B of the bus bar 100. The input terminal placement portion 210, the external terminal placement portion 220A, and the external terminal placement portion 220B have a hollow shape so as to achieve stable placement of the input terminal 110, the integral external terminal 120A, and the integral external terminal 120B.

The lower housing 200 also has, on its lateral side, an accommodating portion 212 having a hollow shape to accommodate the circuit portion 112 of the bus bar 100. The accommodating portion 212 extends in a direction at approximately right angles to the upper side of the lower housing 200. The accommodating portion 212 has a plurality of engagement protrusions 214 that are engageable in corresponding engagement holes 114 in the bus bar 100.

As illustrated in FIG. 3C, the lower housing 200 has, on its bottom side, connector ports (250A to 250D) into and to which connectors CN to be described later are insertable and attachable. The connector ports 250 have bottom surfaces to which the corresponding slits 240 extend. Therefore, the lower ends 142 of the fuse-side external terminals 140 inserted into the slits 240 from the front side (see FIG. 3A) of the lower housing 200 pass through the lower housing 200 to the back side of the lower housing 200 and protrude from the slits 240 in the bottom surfaces of the connector ports 250.

Figure 4A:
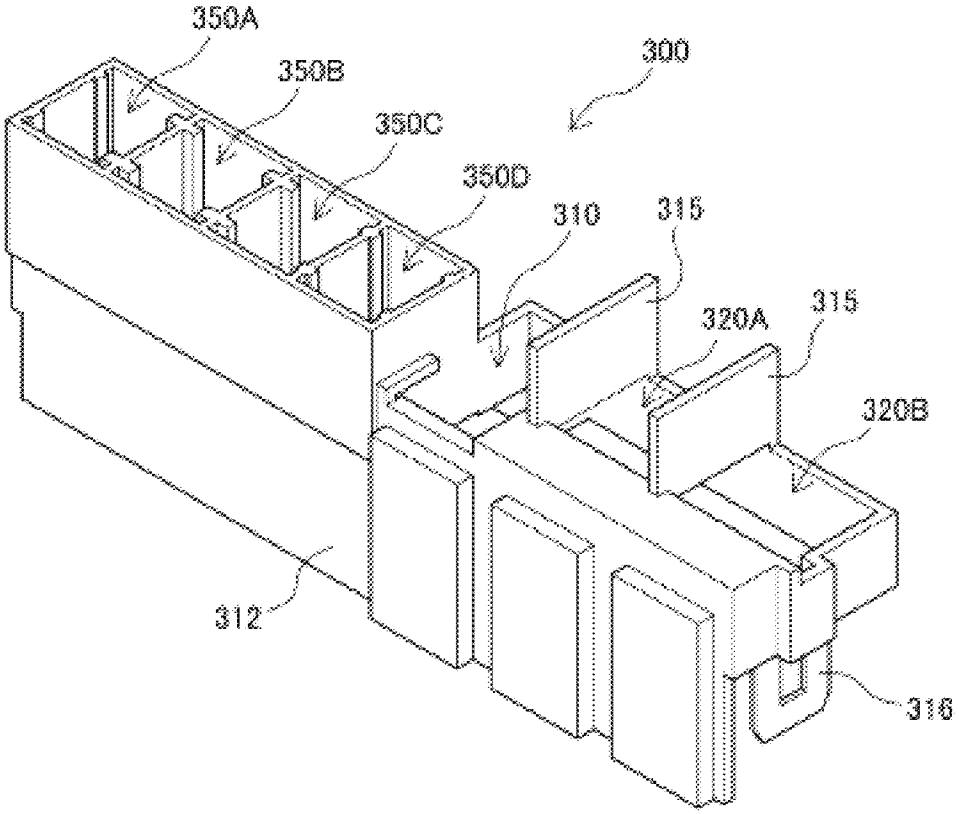
FIG. 4A is a perspective view of an upper housing that constitutes the housing of the multiple fuse device according to the present invention.
Figure 4B:
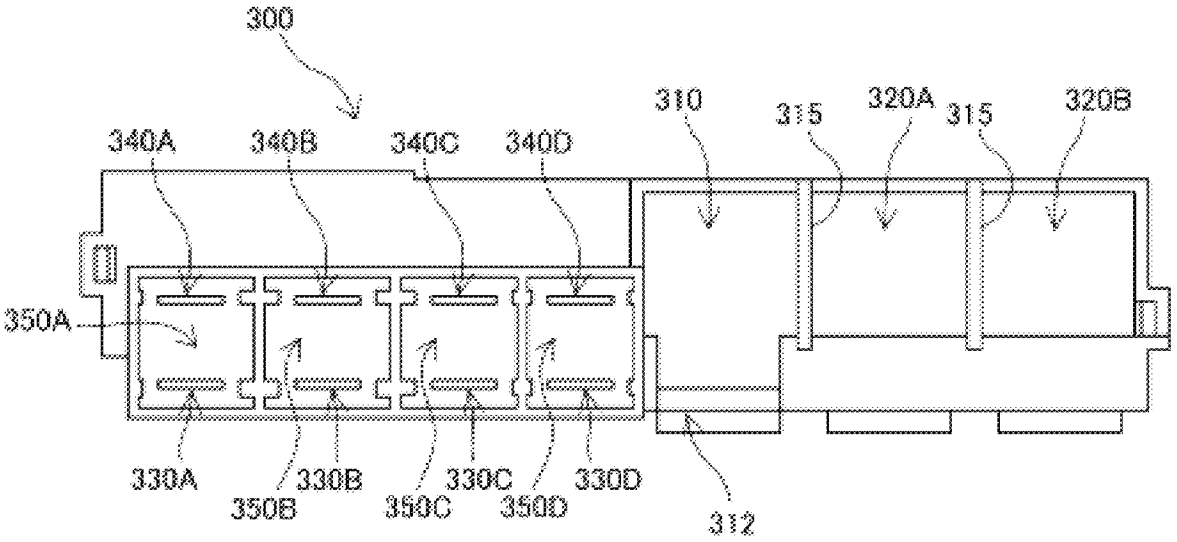
FIG. 4B is a plan view of the upper housing.
Figure 4C:
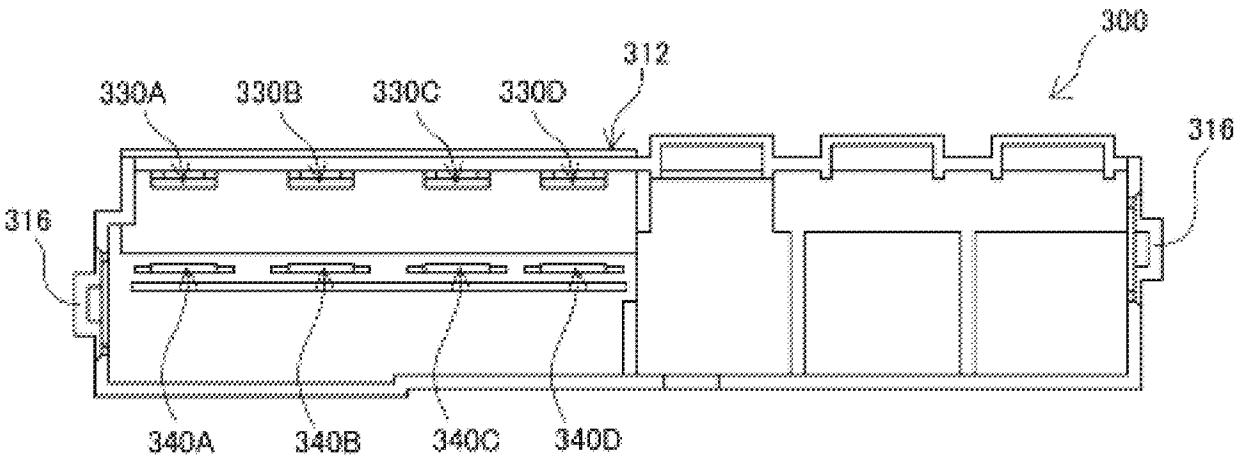
FIG. 4C is a bottom view of the upper housing.

With reference to FIGS. 4A to 4C, next, a detailed description will be given of an upper housing 300 that constitutes the housing 400. The upper housing 300 is made of, for example, an insulating synthetic resin and has an approximately rectangular parallelepiped shape. The upper housing 300 has, in its upper side, through-holes (330A to 330D) through which the fuse connection terminals 130 of the bus bar 100 pass. The through-holes (330A to 330D) are formed with predetermined pitches in one-to-one correspondence with through-holes (340A to 340D) through which the upper ends 141 of the fuse-side external terminals 140 pass. The upper housing 300 also has a fuse port 350A formed to surround the through-hole 330A and the through-hole 340A provided in a pair. Likewise, the upper housing 300 also has fuse ports (350B to 350D) respectively formed to surround the through-holes (330B to 330D) and the through-holes (340B to 340D) provided in a pair.

The upper housing 300 also has, on its upper side, an input terminal window 310 for exposing the input terminal 110 of the bus bar 100, an external terminal window 320A for exposing the integral external terminal 120A of the bus bar 100, and an external terminal window 320B for exposing the integral external terminal 120B of the bus bar 100. The upper housing 300 also has, on its upper side, a partition wall 315 formed between the respective windows.

The upper housing 300 also has, on its lateral side, an accommodating wall 312 for covering and concealing the circuit portion 112 of the bus bar 100. The upper housing 300 also has, on its both ends, fixation holes 316 that engage with fixation protrusions 216 of the lower housing 200 to firmly fix the upper housing 300 to the lower housing 200.

Figure 5:
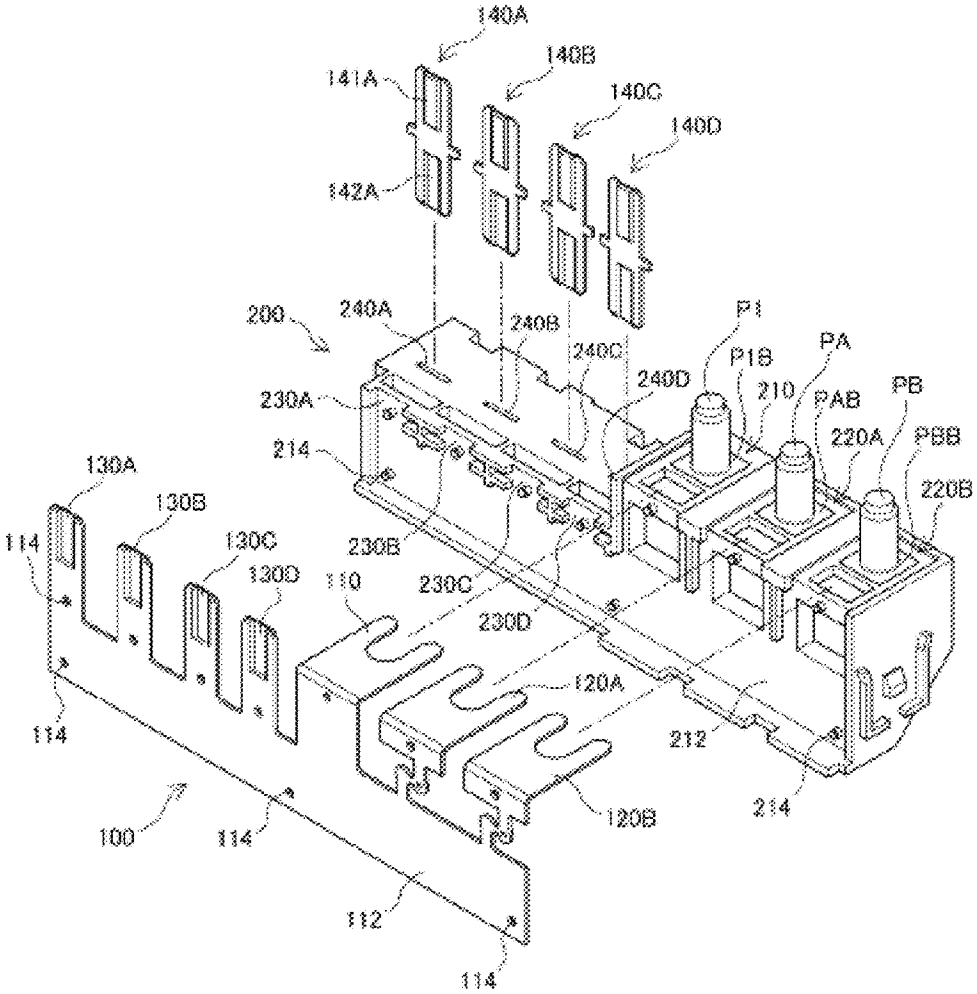
FIG. 5 is an exploded perspective view of the multiple fuse device according to the present invention.

With reference to FIG. 5, next, a description will be given of a way to assemble the multiple fuse device 600 according to the present invention. First, the bus bar 100 is put to the lateral side of the lower housing 200 such that the circuit portion 112 of the bus bar 100 is accommodated in the accommodating portion 212 of the lower housing 200, the input terminal 110 of the bus bar 100 is placed on the input terminal placement portion 210 of the lower housing 200, the integral external terminal 120A of the bus bar 100 is placed on the external terminal placement portion 220A of the lower housing 200, and the integral external terminal 120B of the bus bar 100 is placed on the external terminal placement portion 220B of the lower housing 200. Moreover, the fuse connection terminals 130 are aligned with the corresponding recesses 230. In the alignment, the engagement protrusions 214 of the lower housing 200 are engaged in the corresponding engagement holes 114 in the bus bar 100, so that the bus bar 100 can be placed at its appropriate position and this placed state is easily maintained.

In placing the input terminal 110 on the input terminal placement portion 210, a flange P1B of a connecting bolt P1 is interposed between the input terminal 110 and the input terminal placement portion 210, so that the connecting bolt P1 is fixed on the input terminal placement portion 210. Likewise, a flange PAB of a connecting bolt PA is interposed between the integral external terminal 120A and the external terminal placement portion 220A and a flange PBB of a connecting bolt PB is interposed between the integral external terminal 120B and the external terminal placement portion 220B, so that the connecting bolt PA and the connecting bolt PB are both fixed.

Next, the lower end 142A of the fuse-side external terminal 140A is inserted into the slit 240A from above the lower housing 200 so that the fuse-side external terminal 140A is mounted to the lower housing 200. Likewise, the fuse-side external terminals 140B to 140D are also inserted into the corresponding slits 240B to 240D and are mounted to the lower housing 200.

Figure 6A:
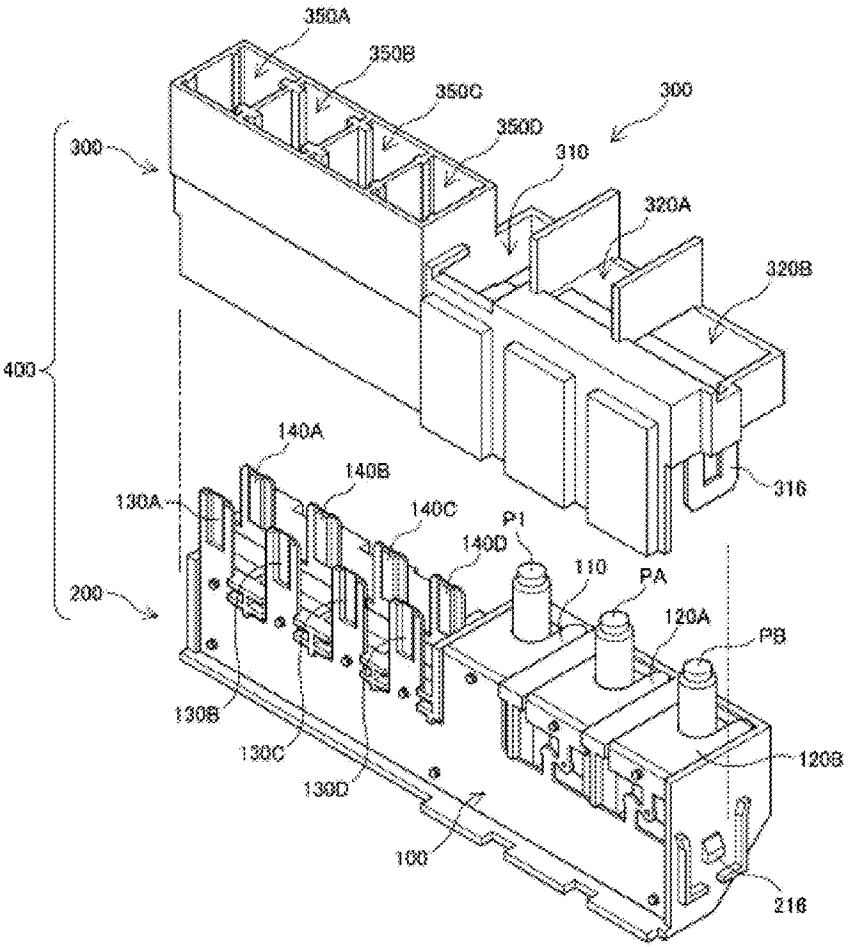
FIG. 6A is an exploded perspective view of the multiple fuse device according to the present invention.
Figure 6B:
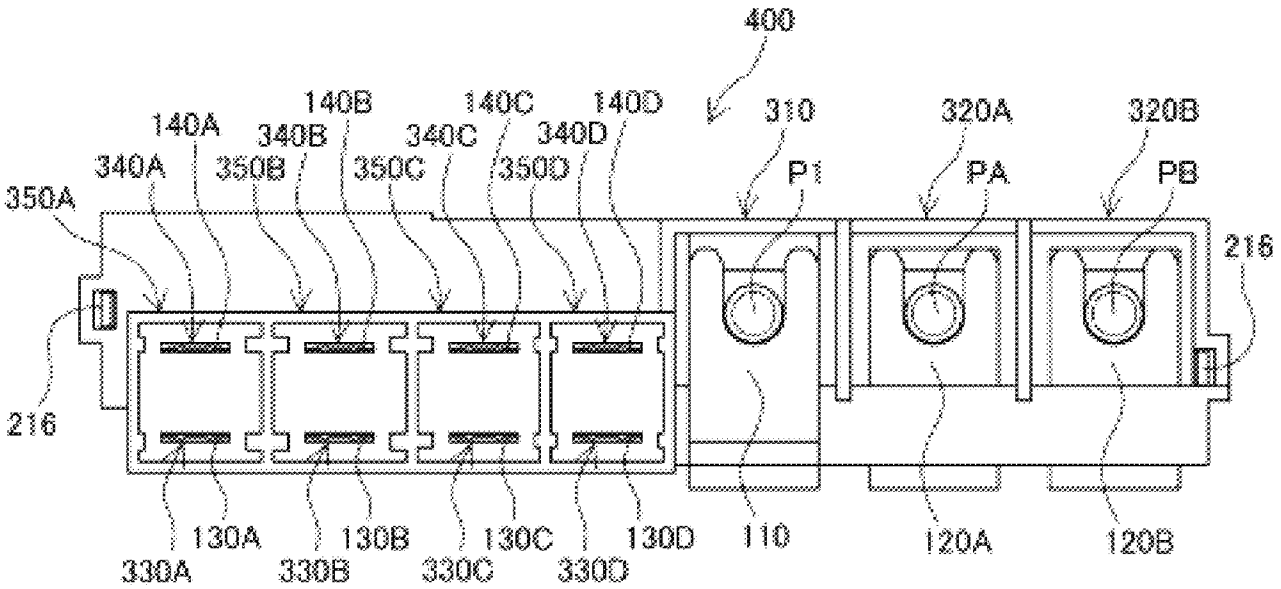
FIG. 6B is a plan view of the multiple fuse device according to the present invention.

As illustrated in FIGS. 6A and 6B, thus, the fuse connection terminal 130A and the fuse-side external terminal 140A provided in a pair are placed on the upper side of the lower housing 200 so as to face each other. Likewise, the fuse connection terminals 130B to 130D and the fuse-side external terminals 140B to 140D respectively provided in a pair are also placed to face each other.

As illustrated in FIGS. 6A and 6B, next, the upper housing 300 is mounted to the lower housing 200 from above the lower housing 200 so as to cover the lower housing 200. Specifically, the fuse connection terminals 130 are inserted into the corresponding through-holes 330 in the fuse ports 350, and the fuse-side external terminals 140 are inserted into the corresponding through-holes 340 in the fuse ports 350. Moreover, the input terminal window 310 is located above the input terminal 110, the external terminal window 320A is located above the integral external terminal 120A, and the external terminal window 320B is located above the integral external terminal 120B. When the fixation protrusions 216 of the lower housing 200 are engaged in the fixation holes 316 in the upper housing 300, the lower housing 200 and the upper housing 300 are firmly fixed together to constitute the housing 400. As a result, the bus bar 100 is covered with the housing 400, and the multiple fuse device 600 according to the present invention is thus assembled.

Figure 7A:
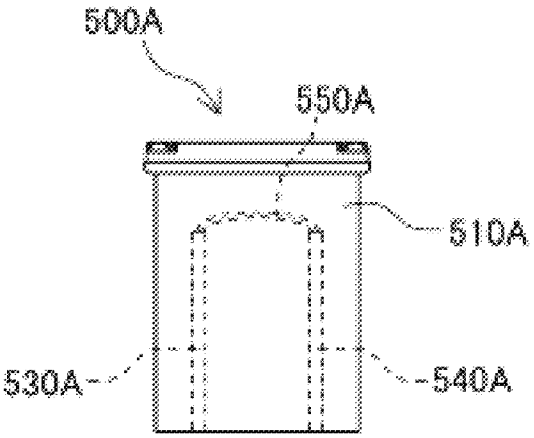
FIG. 7A is a front view of a fuse to be mounted to the multiple fuse device according to the present invention.
Figure 7B:
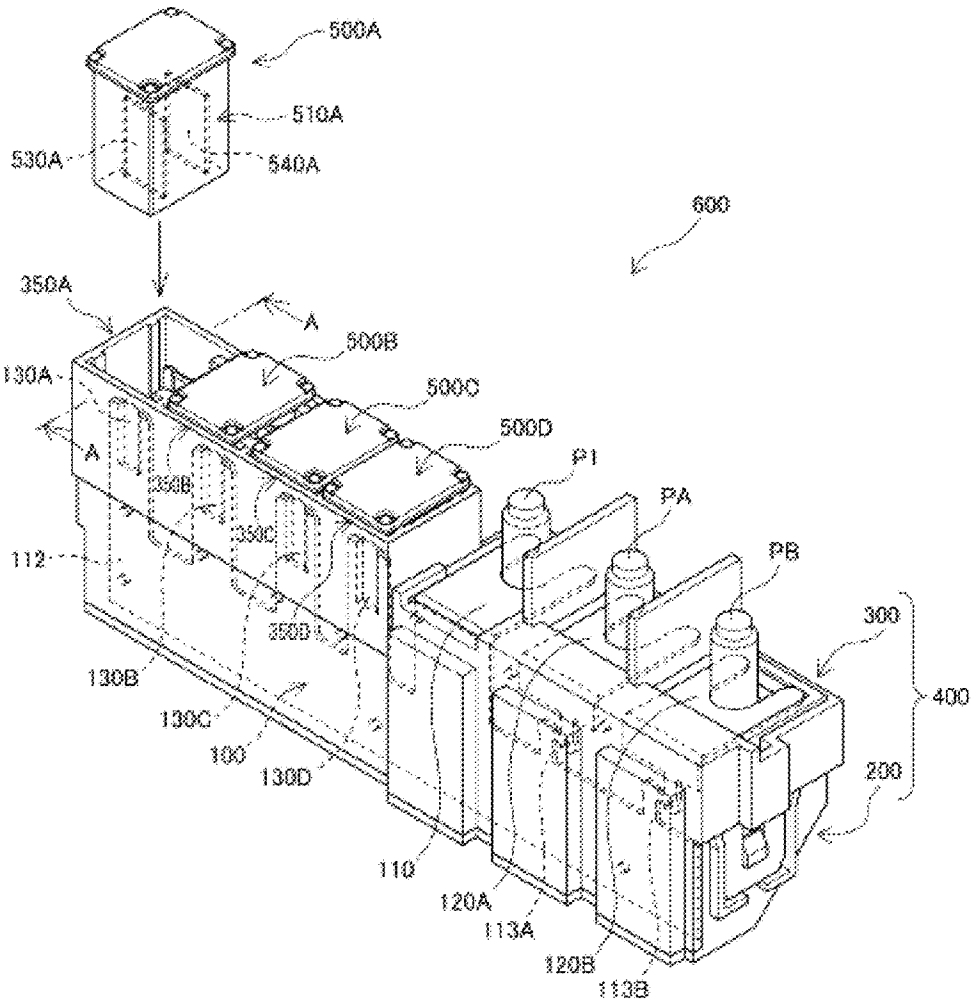
FIG. 7B is a perspective view of the multiple fuse device according to the present invention to which the fuse is mounted.
Figure 7C:
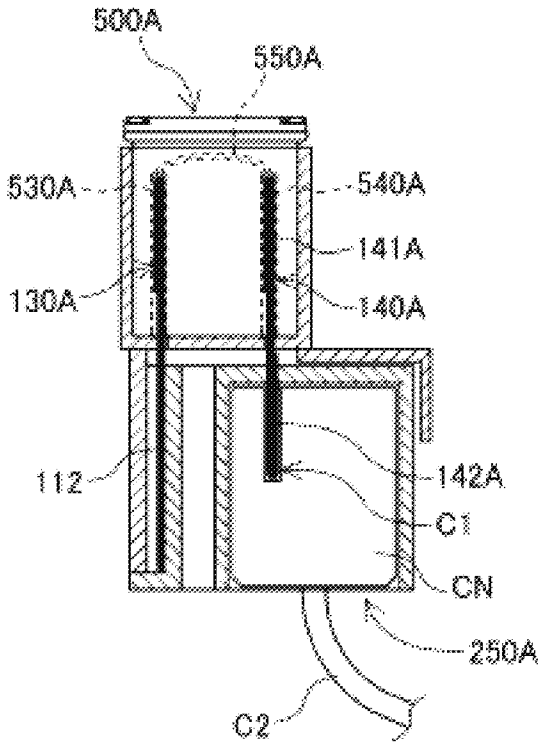
FIG. 7C is a sectional view taken along line A-A in FIG. 7B.

With reference to FIGS. 7A to 7C, next, a description will be given of the use of the multiple fuse device 600 according to the present invention.

In the use of the multiple fuse device 600, a user mounts fuses 500 with desired ratings to the multiple fuse device 600. The fuses 500 are now described. As illustrated in FIG. 7A, the fuse 500A is an existing general fuse having an approximately rectangular parallelepiped shape. The fuse 500A is entirely covered with a housing 510A made of, for example, an insulating synthetic resin. The fuse 500A includes a female terminal 530A and a female terminal 540A each made of a metal. The female terminal 530A and the female terminal 540A are connected to each other with a fusible portion 550A.

As illustrated in FIG. 7B, the fuse 500A is inserted into the fuse port 350A of the multiple fuse device 600 and is thus mounted to the multiple fuse device 600. Likewise, the fuses 500B to 500D are inserted into the corresponding fuse ports 350B to 350D and are thus mounted to the multiple fuse device 600. The fuses 500A to 500D are identical in structure with one another except ratings of the respective fusible portions 550A to 550D. Therefore, each of the fuses 500A to 500D may be inserted into any fuse port 350. Accordingly, the user of the multiple fuse device 600 may mount a fuse 500 with a desired rating to a fuse port 350 of choice in accordance with an electrical component to be coupled to the multiple fuse device 600. The fuses 500 are removable from the fuse ports 350. Therefore, the fuses 500 are exchangeable repeatedly in accordance with, for example, a change in rating.

Next, a brief description will be given of functional effects of the fuses 500. As illustrated in FIG. 7C, the fuse connection terminal 130A of the bus bar 100 is inserted into and connected to the female terminal 530A of the fuse 500A and the upper end 141A of the fuse-side external terminal 140A is inserted into and connected to the female terminal 540A of the fuse 500A, with the fuse 500A mounted to the fuse port 350A. Moreover, the lower end 142A of the fuse-side external terminal 140A protrudes from the connector port 250A on the back side and is connected to a female terminal C1 of a connector CN mounted to the connector port 250A.

Under normal conditions, current supplied from the power supply connected to the input terminal 110 flows from the circuit portion 112 of the bus bar 100 to the fuse connection terminal 130A and then flows to the fuse-side external terminal 140A via the fusible portion 550A. The current then flows from the lower end 142A of the fuse-side external terminal 140A to a wire C2 connected to the female terminal C1 of the connector CN and is supplied to a load such as an electrical component connected to the wire C2. If overcurrent is supplied from the power supply connected to the input terminal 110, the fusible portion 550A is cut to protect the load such as the electrical component connected to the wire C2 from the inflow of the overcurrent. Likewise, the fuses 500B to 500D protect loads such as various electrical components coupled thereto from the inflow of overcurrent supplied from the power supply connected to the input terminal 110.

With regard to the integral external terminal 120A and the integral external terminal 120B, if overcurrent is supplied from the power supply connected to the input terminal 110, the fusible portion 113A and the fusible portion 113B are cut to protect loads such as various electrical components coupled to the integral external terminal 120A and the integral external terminal 120B, respectively.

As described above, the multiple fuse device 600 according to the present invention easily copes with a change in rating of a fusible portion associated with changes in types of vehicles, service conditions, and the like in such a manner that the user appropriately mounts a fuse 500 with a desired rating to the multiple fuse device 600. Unlike the conventional art, the multiple fuse device 600 according to the present invention has no necessity to change a die depending on a change in rating of a fusible portion, which brings about a reduction in manufacturing cost.

In addition, the multiple fuse device 600 according to the present invention achieves the combined use of the fusible portions 113 integrated with the bus bar 100 and the fusible portions 550 of the removable fuses 500. This configuration can reduce a necessity to change a die as much as possible even when a rating is changed. Therefore, the multiple fuse device 600 according to the present invention can produce an advantageous effect of reducing an effort to mount a fuse 500 while producing an advantageous effect of reducing manufacturing cost as much as possible. Specifically, in the multiple fuse device 600, the fusible portions 113 are integrated with a part of the bus bar 100. It is therefore considered that a change in rating of a load coupled to each fusible portion 113 causes a necessity to change a die for manufacturing the bus bar 100. To this end, if the multiple fuse device 600 is designed to omit all the fusible portions 113 and to employ only the fusible portions 550 of the removable fuses 500, a die is not changed at all even when a rating is changed. However, this configuration increases work for mounting the fuses 500.

Typically, a power supply such as a battery for use in an automobile is connected to both a load (e.g., an alternator, a starter) of which the rating does not relatively change depending on changes in types of vehicles, service conditions, and the like and a load (e.g., a radiator) of which the rating relatively changes depending on changes in types of vehicles, service conditions, and the like.

In view of this, the present invention provides the configuration where a load of which the rating does not relatively change is coupled to each fusible portion 113 integrated with the bus bar 100, whereas a load of which the rating relatively changes is coupled to the fusible portion 550 of each fuse 500 separate from the bus bar 100. As a result, it becomes unnecessary to change the shape and the like of each fusible portion 113 coupled to a load of which the rating does not relatively change and it becomes also unnecessary to change a die. Therefore, the manufacturing cost can be reduced as much as possible. Moreover, employing the integral fusible portions 113 can eliminate the work for mounting the fuses 500. On the other hand, changing each fuse 500 can easily cope with a load of which the rating relatively changes.

The multiple fuse device 600 according to the present invention includes the connector ports 250 for mounting the connectors CN. This configuration reduces a conventional effort of fastening with a bolt. The fastening with a bolt means that, as illustrated in FIG. 7B, external terminals coupled to loads such as various electrical components are fastened to the connecting bolt P1, connecting bolt PA, and connecting bolt PB with nuts or the like.

The multiple fuse device according to the present invention is not limited to the foregoing embodiment, and various modifications and combinations may be made within the scope of the appended claims and the scope of the embodiment. These modifications and combinations are also encompassed within the technical range of the present invention.

What is claimed is:

1. A multiple fuse device comprising:

an input terminal;

a bus bar that includes a circuit portion connected to the input terminal; and a housing that covers the bus bar, wherein the multiple fuse device comprises:

an integral external terminal integrated with the circuit portion with a fusible portion interposed between the integral external terminal and the circuit portion; and a plurality of fuse-side external terminals that pairs up with a plurality of fuse connection terminals connected to the circuit portion, and the fuse connection terminal and the fuse-side external terminal provided in a pair to hold a fuse exteriorly in a removable manner, the fuse having a fusible portion connected between the fuse connection terminal and the fuse-side external terminal, the fuse-side external terminals are structurally independent from each other and are arranged in a row, an upper end of each fuse-side external terminal is inserted into and connected to the fuse, and a lower end of each fuse-side external terminal is attached by being independently inserted into a slit of the housing and projects into a corresponding connector port, a connector comprising a female terminal coupled to a wire connected to an external load is inserted to the connector port, the lower end of the fuse-side external terminal is connected to the female terminal, current from the input terminal flows from the lower end of the fuse-side external terminal to the female terminal of the connector via a fusible portion of the fuse, and the current is supplied to the external load via the wire coupled to the female terminal.

* * * * *